United States Patent [19]

Vladimir

[11] Patent Number: 4,748,807

[45] Date of Patent: Jun. 7, 1988

[54] LOOSE MATERIAL CATALYZER

[75] Inventor: Brunner Vladimir, Regensburg, Fed. Rep. of Germany

[73] Assignee: Vemas Vertriebs- und Marketing-Gesellschaft m.b.H., Munich, Fed. Rep. of Germany

[21] Appl. No.: 92,229

[22] Filed: Sep. 2, 1987

[30] Foreign Application Priority Data

Sep. 2, 1986 [DE] Fed. Rep. of Germany ..... 3631392

[51] Int. Cl.[4] ..... F01N 3/28

[52] U.S. Cl. ..... 60/299; 422/179; 422/221

[58] Field of Search ..... 60/299; 422/179, 221

[56] References Cited

U.S. PATENT DOCUMENTS 3,838,977 10/1974 Warren ..... 422/179

3,930,805 1/1976 Vogt ..... 422/179

*Primary Examiner*—Douglas Hart

*Attorney, Agent, or Firm*—Becker & Becker, Inc.

[57] ABSTRACT

A loose material catalyzer disposed in the exhaust pipe of an internal combustion engine for purifying the exhaust gases thereof. The catalyzer includes a housing having a cylindrical wall. A first perforated plate is disposed in the housing essentially perpendicular to the cylindrical wall thereof, and receives exhaust gases for purification. A second perforated plate is disposed in the housing essentially perpendicular to the cylindrical wall thereof and allows purified exhaust gases to proceed downstream. A catalyst bed is disposed in the housing and is bounded by the cylindrical wall thereof and the two perforated plates. The catalyst bed is provided with granular catalyst material that tends to disappear during use, whereby the first, upstream perforated plate is axially movably disposed in the housing to compensate for the disappearance of the catalyst material. A magnet arrangement is disposed on the outside of the catalyzer and includes an armature, in the catalyzer, that acts on the first perforated plate to press the latter against the material of the catalyst bed.

14 Claims, 2 Drawing Sheets

LOOSE MATERIAL CATALYZER

BACKGROUND OF THE INVENTION

The present invention relates to a loose material catalyzer (catalytic converter) that is disposed in an exhaust pipe of an internal combustion engine for purifying the exhaust gases thereof.

The problem of such catalyzers is, with as little resistance to flow as possible, to offer as great a reaction surface as possible in the least amount of space. In this context, reaction surface refers to the catalytically active surface. With porous fixed catalyzers, the resistance to flow is critical. In contrast, in honeycomb arrangements with favorable flow conditions, the reaction surface is limited. With loose material catalyzers, depending upon the size of the granular catalyst material, a favorable ratio can be achieved between the reaction surface that is offered and the resistance to flow; this can be accomplished in a very small space, especially when the inner reaction surface of the granules is large. This is primarily the case with zeolitic material. However, granular catalyst material has the drawback that during operation, it is consumed under the effect of the pulsation of the exhaust gases of the internal combustion engine due to the fact that the granules rub against one another, so that by the time the catalytic effect has been depleted, a considerable amount of the catalyst material has disappeared. Due to the greater freedom of movement for the individual granules that then results, this effect continues to increase. If the worn-away material is not carried away by the flow of the medium that is to be purified, a clogging or obstruction of the reaction surfaces, and especially of the inner surfaces of the catalytic packing, occur; as a result, the catalytic efficiency is increasingly reduced. The vibrations generated by the enhaust pulses of the internal combustion engine increase considerably with land vehicles due to the vibrations caused during a driving operation. For this reason, it has been tempted to compensate for the disappearance of the loose material packing by resiliently pressing one of two radial perforated plates of the catalyzer bed, thereby attempting to always hold the catalyst granules at the same tight contact in order to eliminate movements of the granules relative to one another.

German Offenlegungsschrift No. 17 67 532 discloses an example of a catalytic packing of granular material, with no allowance being made for the disappearance of the catalytic material.

In German Pat. No. 644 734, it was attempted to achieve a uniform content of the catalyst bed via spring pressure on a refill container for the granular catalyst material. Although this had the advantage that the spring that exerts a pressure on the catalyst packing was to some extent disposed beyond the heat region of the actual catalyzer, such a device is unsuitable for vehicles, already because of space reasons, and the pressure that is exerted can suffice only for a refilling, but not for establishing a uniform tight contact of the granules against one another.

German Offenlegungsschrift No. 22 42 888 discloses a spring arrangement that is disposed externally of the actual catalyzer, and that acts axially upon the perforated plates that delimit the catalyst bed. Although in this way the spring is disposed externally of the heat region of the catalyzer, it means that the hot medium that is to be purified has to be supplied and withdrawn radially from the catalyzer. Furthermore, to exclude secondary air, passages for the rod linkage that transmits the contact pressure, along with seals that are exposed to the thermal stress, are necessary. In addition, with the representative or feasible expansions of such a unit, the heat conduction soon reaches the pressure springs via the rod linkage. Due to the space considerations alone, this heretofore known catalyzer is practically useless for vehicles.

German Offenlegungsschrift No. 23 10 843 discloses a further spring-operated unit where the perforated plates, which on both sides are axially movable, are pressed against the catalyst packing by a tension spring that is disposed in the axial center of the catalyst bed. This keeps the spring linkage from having to pass through the walls of the housing. However, this tension spring is completely exposed to the heat of the exhaust gas stream, with this heat being increased even further in the catalyzer due to dissipation of the flow energy, so that even when the internal combustion engine is not very close, and the exhaust gases can therefore be cooled somewhat, one must still count on temperatures of greater than 800° C. The material of the spring cannot withstand such thermal stresses over any length of time, so that catalyzers of this type have therefore proven unsatisfactory in operation.

It is therefore an object of the present invention to provide a device that can keep the granules of the packing material of the catalyst bed in uniform close contact with one another during continuous operation, and in conformity to the increasing disappearance of the catalyst material, without having to take into consideration the resulting thermal load, and without openings in the walls of the housing for a rod linkage.

It a further oject of the present invention to be able to use such a device in motor vehicles, in other words, the device must be able to withstand the vibrations of the vehicle during operation, with the device furthermore having such dimensions that it is possible for it to be mounted on the underside of a vehicle.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

The loose material catalyzer of the present invention comprises: a housing having a cylindrical wall; a first perforated plate that is disposed in the housing essentially perpendicular to the cylindrical wall thereof, and that receives exhaust gases for purification; a second perforated plate that is disposed in the housing and allows purified exhaust gases to proceed downstream; a catalyst bed disposed in the housing and bounded by the cylindrical wall thereof and by the perforated plates, the catalyst bed being provided with granular catalyst material that tends to disappear during use, whereby the first, upstream perforated plate is axially movably disposed in the housing to compensate for the disappearance of the catalyst material; and a magnet arrangement that is disposed on the outside of the catalyzer and includes an armature in the catalyzer that acts on the first perforated plate to press the latter against the material of the catalyst bed.

Disposing permanent magnets on the outside of the catalyzer, and especially on the outer side of the housing for the catalyst bed, makes it possible to exert the necessary pressure on the movable perforated plate without having to have mechanical passages in the wall of the housing, thus avoiding all danger of entry of secondary air as well as failure of seals at the passages for spring rod linkages.

The magnetic properties not only of the magnets but also of the armature material are not eliminated or reduced by the thermal stress. Magnetic material is economically available that, in contrast to pressure springs, can be subjected to temperatures that are considerably greater than 100° C. without any observable reduction in magnetic properties thereof.

If zeolitic catalyst material is used, the catalyst bed of the present invention can have a relatively short axial dimension along with a radial dimension that is acceptable for motor vehicle conditions, so that the resistance to flow remains as small as possible. It is easily possible to replace the used-up catalyst packing by removing the outlet pipe and the fixed perforated plate, so that it is not necessary to replace the entire catalyzer when its catalytic effect is depleted. In this connection, the granular catalyst material can be inserted in prefabricated packages or cartridges.

Further specific features of the present invention will be described in detail subsequently.

DESCRIPTION OF PREFERRED EMBODIMENTS

Figure 1:
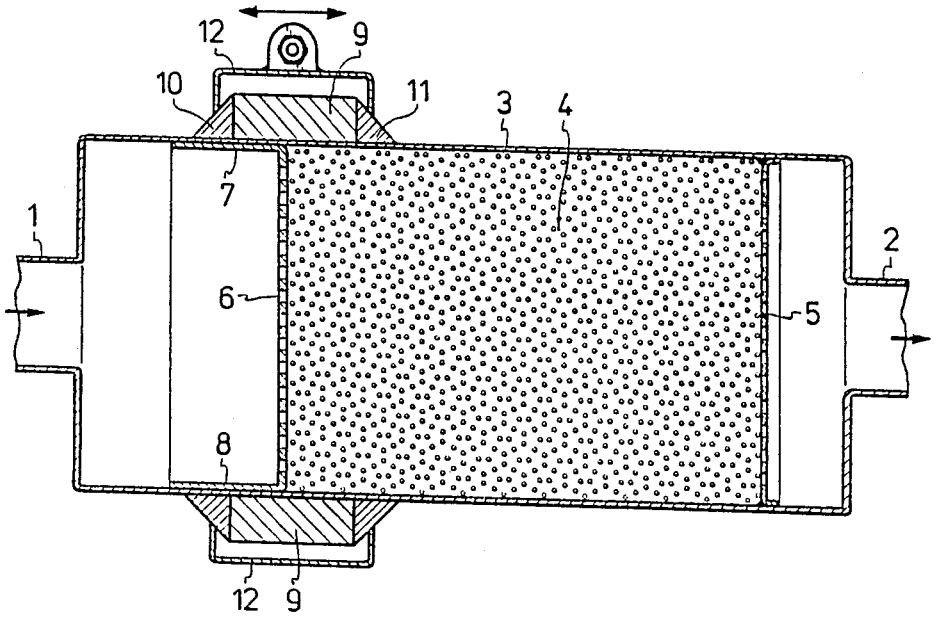
FIG. 1 is an axial cross-sectional view through one exemplary embodiment of the inventive catalyzer.
Figure 2:
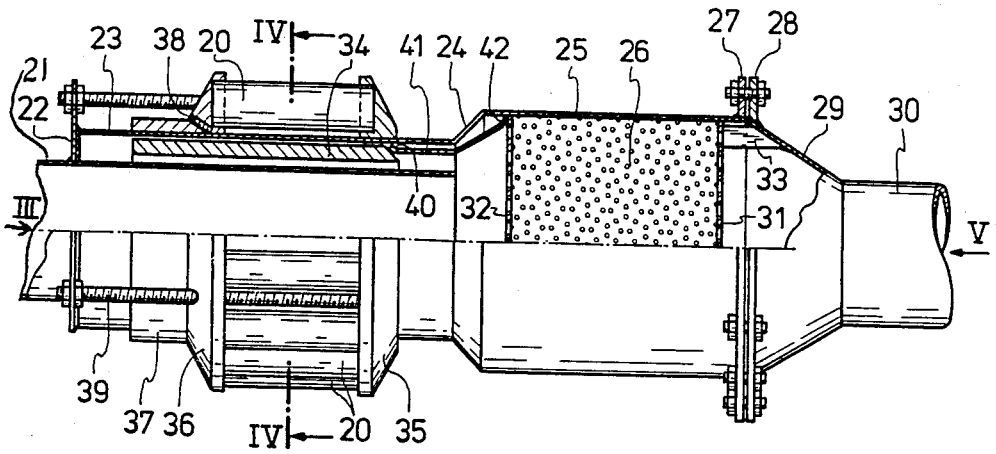
FIG. 2 is a partially sectioned view of a second exemplary embodiment of the inventive catalyzer.
Figure 3:
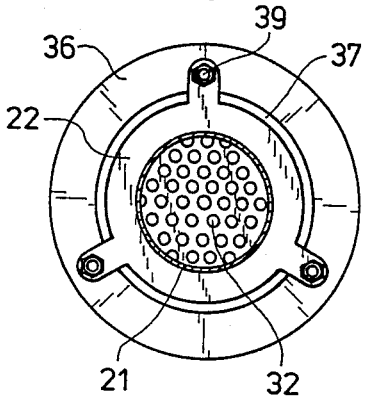
FIG. 3 is an end view of the inventive catalyzer in the direction of flow as seen in the direction of the arrow III in FIG. 2.
Figure 4:
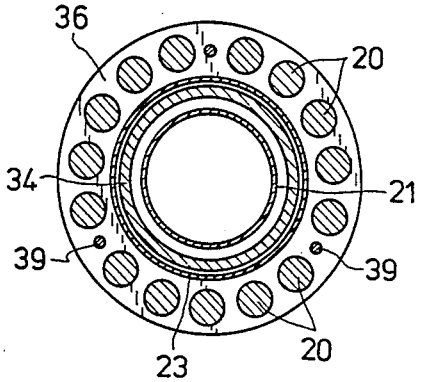
FIG. 4 is a radial cross-sectional view of the inventive catalyzer taken along the line IV—IV in FIG. 2.
Figure 5:
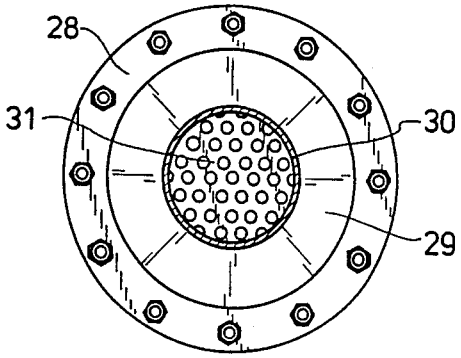
FIG. 5 is an end view of the inventive catalyzer counter to the direction of flow as seen in the direction of the arrow V in FIG. 2.

Referring now to the drawings in detail, in the catalyzer or catalytic converter illustrated in FIG. 1, a widened, cylindrical housing 3 of non-magnetic material is coaxially disposed between the inlet pipe 1 for the unpurified exhaust gases and the outlet pipe 2 for the purified exhaust gases; the inlet pipe 1 is connected to the not-illustrated exhaust manifold of the internal combustion engine. The housing 3 accommodates a catalyst bed 4 of granular catalyst material. On the outlet side, the housing 3 is closed off by the screen, in the form of a perforated plate 5, which is welded to the inner periphery of the housing. On the inlet side, an axially movable screen in the form of a perforated plate 6 is provided that is connected to an annular armature 7 of ferromagntic material. The annular armature 7 is provided on the periphery of the plate 6 above the latter, and is movable in the axial direction on the inner wall of the housing 3. The armature 7 can be a hollow cylinder or, as illustrated in the drawing, to guide it, the armature can be connected to a cylindrical carriage 8 that is made from a ferromagnetic sheet of material and slides on the inner wall of the housing 3. The perforated plate 6 closes off the catalyst bed 4 on the inlet side.

Disposed on the outside of the housing 3 in the region of the annular armature 7 are a plurality of rod-like permanent magnets 9. The magnets are held in an axial direction by rings 10 and 11 that are made of ferromagnetic material and are disposed about the housing 3. When seen in an axial cross-sectional view, the rings 10 and 11 each have the shape of a right triangle, one leg of which presses against the housing 3, while the other leg presses against the end faces of the permanent magnets 9 under the force of the pressure exerted by the arms of a clamping ring 12.

The annular armature 7, and hence the perforated plate 6, are moved in the direction toward the outlet side due to the effect of the magnets 9, assisted by the pressure of the entering exhaust gas.

The primary task of the rings 10 and 11 is to transmit the magnetic field forces onto the annular armature 7, or onto the carriage 8 that forms a magnetic unit with the armature 7, thereby magnetically bridging the gap between the permanent magnets 9 and the housing 3.

The permanent magnets 9 are provided at that level of the housing 3 that corresponds to the end position of the perforated plate 6 when the catalyst granules in the bed 4 are used up. The magnetic forces that act upon the perforated plate 6 can be increased by shifting the permanent magnets 9 downwardly, i.e. in the direction toward the outlet. This movement is made possible by loosening the clamping ring 12.

In the embodiment illustrated in FIGS. 2 to 5, the permanent magnets 20 are disposed in the region of the inlet pipe 21 on a shell or jacket 23 that is disposed about the inlet pipe and is welded thereto via an annular plate 22. After a conical enlargement 24, the jacket 23 forms the housing 25 for the catalyst bed 26. Provided on the right side of the housing 25 is a flange 27 that is bolted to a flange 28 of a conical enlargement 29 of the outlet pipe 30. On the outlet side, the catalyst bed 26 is closed off by a screen that is in the form of a perforated plate 31. On the inlet side, the catalyst bed 26 is closed off by a screen that is in the form of the perforated plate 32. Both perforated plates 31 and 32 are loose and axially movable, through their peripheries rest closely against the inner side of the housing 25. After the outlet pipe 30 has been removed at the flanges 27 and 28, the perforated plate 31 can be removed to fill or refill the catalyst bed 26. A spacer 33 assures the position of the perforated plate 31 as a closure for the filled catalyst bed 26. The spacer 33 rests against the conical enlargement 29 of the outlet pipe 30. Between the inlet pipe 21, which ends prior to the catalyst bed 26, and the jacket 23, the hollow cylindrical annular armature 34 is slidingly disposed on the inner wall of the jacket 23 in such a way that it can be moved axially. Fifteen rod-like permanent magnets 20 are provided on the outer side of the jacket 23, which is made of non-magnetic material. On the outlet side, the end face of these permanent magnets 20 are disposed in bores in a ring 35 that is disposed about the jacket 23 in such a way that it is axially movable thereon; on the inlet side, the end faces of the magnets 20 are disposed in bores in a similar ring 36. Both of the rings 35 and 36 are made of ferromagnetic material, and simultaneously serve for introducing the magnetic forces onto the annular armature 34. the ring 36 on the inlet side is provided with a sleeve-like extension 37 via which the ring 36 can be fixed to the jacket 23 by means of screws 38. Provided between at least some of the magnets 20 are axially oriented clamping screws 39 that via arm-like flanges on the plate 22 are screwed into the movable ring 35 and press the latter against the permanent magnets 20 and the fixed ring 36.

On the outlet side at 40, within the conical enlargement 24 of the jacket 23, the annular armature 34 rests against a similarly conically expanding tube 41. The rim 42 on the outlet end of the tube 41 rests against the rim of the perforated plate 32, pressing the latter against the material of the catalyst bed 26 under the effect of the permanent magnets 20. After loosening the clamping screws 39, the axial position of the magnets can be altered by shifting the ring 37 accompanied by appropriate setting of the clamping screws 39, thus adjusting the effect of the magnets 20.

The present invention is, of course, in no way restricted to the specific disclosure of the specification and drawings, but also encompasses any modifications within the scope of the appended claims.

What I claim is:

1. A loose material catalyzer disposed in the exhaust pipe of an internal combustion engine for purifying the exhaust gases thereof, said catalyzer comprising:

a housing having a cylindrical wall;

a first perforated plate disposed in said housing essentially perpendicular to said cylindrical wall thereof, with said first perforated plate receiving exhaust gas for purification;

a second perforated plate disposed in said housing essentially perpendicular to said cylindrical wall thereof, with said second perforated plate allowing purified exhaust gas to proceed downstream;

a catalyst bed disposed in said housing and bounded by said cylindrical wall thereof and by said two perforated plates, said catalyst bed being provided with granular catalyst material that tends to disappear during use, whereby said first, upstream perforated plate is axially movably disposed in said housing so that it can compensate for said disappearance of said catalyst material; and a magnet arrangement that is disposed on the outside of said catalyzer and includes an armature, in said catalyzer, that acts on said first, movable perforated plate to press the latter against said material of said catalyst bed to effect said compensation.

2. A catalyzer according to claim 1, in which said armature is an annular armature that acts against a rim of said first, movable perforated plate.

3. A catalyzer according to claim 2, which includes a carriage of ferromagnetic material that is disposed in said housing in such a way that it slides on said cylindrical wall thereof, with said annular armature being secured to said carriage.

4. A catalyzer according to claim 2, in which said annular armature is a hollow cylinder.

5. A catalyzer according to claim 4, which includes an inlet pipe connected to said exhaust pipe, upstream of said catalyst bed, for receiving exhaust gas and conveying same to said first, movable perforated plate; and which includes a jacket that is disposed about said inlet pipe, with said hollow cylindrical annular armature being disposed between said inlet pipe and said jacket in such a way that said armature can shift in an axial direction.

6. A catalyzer according to claim 5, in which said magnet arrangement includes permanent magnets.

7. A catalyzer according to claim 6, in which said permanent magnets are a plurality of axially directed rod magnets that are disposed about said jacket.

8. A catalyzer according to claim 7, in which said magnets have end faces; and which includes two rings of ferromagnetic steel that are disposed about said jacket, with said magnets being disposed between said rings in such a way that their end faces rest against said rings.

9. A catalyzer according to claim 5, in which said jacket is made of non-magnetic material.

10. A catalyzer according to claim 5, which includes a conical enlargement that connects said jacket to said housing, with said magnet arrangement and said annular armature thereof being disposed upstream of said conical enlargement; and which includes a tube that widens in the manner of a funnel, said tube being disposed between said annular armature and said first, movable perforated plate for transmitting pressure from said armature onto said rim of said movable plate.

11. A catalyzer according to claim 4, in which said magnet arrangement includes permanent magnets.

12. A catalyzer according to claim 11, in which said permanent magnets are a plurality of axially directed rod magnets that are disposed about said housing.

13. A catalyzer according to claim 12, in which said magnets have end faces; and which includes two rings of ferromagnetic steel that are disposed about said housing, with said magnets being disposed between said rings in such a way that their end faces rest against said rings.

14. A catalyzer according to claim 1, in which said housing is made of non-magnetic material.

* * * * *

UNITED STATES PATENT AND TRADEMARK OFFICE

CERTIFICATE OF CORRECTION

PATENT NO. : 4,748,807

DATED : June 7, 1988

INVENTOR(S) : Vladimir Bruner

It is certified that error appears in the above-identified patent and that said Letters Patent is hereby corrected as shown below:

Please correct the above patent as follows:

On the Title-Abstract page:

[75] Inventor: Vladimir Bruner, Regensburg, Fed. Rep. of Germany

[30] Foreign Application Priority Data
Sep. 16, 1986 [DE] Fed. Rep. of Germany..3631392

[19] "Vladimir" to read -- Bruner --.

Signed and Sealed this

Twenty-fifth Day of October, 1988

*Attest:*

DONALD J. QUIGG

*Attesting Officer*

*Commissioner of Patents and Trademarks*